US005951004A

United States Patent [19]

Hadfy-Kovacs et al.

[11] Patent Number: 5,951,004

[45] Date of Patent: Sep. 14, 1999

[54] METHOD OF AND APPARATUS FOR BUFFERING PAPER SHEETS

[75] Inventors: Imre Hadfy-Kovacs, Reuver; Petrus Antonius Maria Donkers, Gemert, both of Netherlands

[73] Assignee: OCE-Technologies B.V., Ma Venlo, Netherlands

[21] Appl. No.: 08/882,112

[22] Filed: Jun. 25, 1997

[30] Foreign Application Priority Data

Jun. 25, 1996 [NL] Netherlands ..... 1003415

[51] Int. Cl.[6] ..... B65H 29/00

[52] U.S. Cl. ..... 271/184; 271/176; 271/303; 414/789.1; 414/790.2; 270/58.02; 399/402

[58] Field of Search ..... 414/789.1, 790.2, 414/790.3; 270/58.02, 58.07, 58.08; 271/207, 176, 902, 303, 306, 184; 399/388, 402

[56] References Cited

U.S. PATENT DOCUMENTS

| | | | |
|---|---|---|---|
| 4,129,377 | 12/1978 | Miyamoto et al. | 399/388 |
| 4,511,297 | 4/1985 | Wilson et al. . | |
| 4,801,134 | 1/1989 | Yokoyama et al. | 271/122 |
| 5,008,713 | 4/1991 | Ozawa et al. | 399/402 |
| 5,093,690 | 3/1992 | Ohno et al. | 271/184 |
| 5,289,251 | 2/1994 | Mandel et al. . | |
| 5,303,017 | 4/1994 | Smith . | |
| 5,364,085 | 11/1994 | Kennish | 270/58.02 |
| 5,752,134 | 5/1998 | Hazama et al. | 399/388 |
| 5,788,227 | 8/1998 | Hendrix et al. | 271/184 |

FOREIGN PATENT DOCUMENTS

| | | | |
|---|---|---|---|
| 488126 | 6/1992 | European Pat. Off. | 271/184 |
| 0613846 A1 | 9/1994 | European Pat. Off. . | |
| 2257125 | 1/1993 | United Kingdom . | |

OTHER PUBLICATIONS

Burlew, et al. "Copy finisher," Research Disclosure (Mar. 1978) pp. 61–67.

*Primary Examiner*—James W. Keenan
*Assistant Examiner*—Douglas Hess

[57] ABSTRACT

A method of assembling successively fed paper sheets subjected to a printing treatment, and groupwise delivery thereof to a following station for further treatment, is described. The paper sheets are fed by a first transport mechanism along a main transit path over a guide mechanism to a second transport mechanism situated at a distance therefrom in the processing direction. The paper sheets are engaged by the second transport mechanism for transport in the processing direction. The second transport mechanism, for the purpose of receiving each following paper sheet in the group, is temporarily driven in a direction opposite to the processing direction. The trailing part of each of the sheets returned by the second transport mechanism is deflected out of the main transit path.

15 Claims, 4 Drawing Sheets

METHOD OF AND APPARATUS FOR BUFFERING PAPER SHEETS

BACKGROUND OF THE INVENTION

1. Field of the Invention

The invention relates to a method of assembling successively fed paper sheets subjected to a printing treatment, and groupwise delivery thereof to a following station for further treatment. The invention also relates to an apparatus for performing a method of this kind.

2. Description of the Background Art

In printing apparatus, such as copying machines and printers, successive paper sheets provided with different images by the printing apparatus are assembled, for example to form manageable bundles, e.g. by means of a staple delivered by a stapling machine included in the printing apparatus. It is also possible that the paper sheets will be joined together somewhere else, but the paper sheets must be available in packets for the purpose. In all these cases, the continuous sequential processing of the paper sheets is converted into a group-wise (end) processing. Appropriate steps must be taken to ensure that the continuous actions may take place unobstructedly during the group processing, e.g. the alignment of a stack of paper sheets and the passing of a staple therethrough.

Buffer systems suitable for this purpose are known, for example, from U.S. Pat. No. 5,289,251 and European patent application 0 613 846. Both of these documents refer to two pairs of transport rollers spaced apart in the processing direction. After a first sheet has arrived at the downstream rollers, the driving effect thereof on that paper sheet is eliminated, so that the paper sheet is stopped and the end processing of a packet already assembled can take place unobstructedly. A second paper sheet is then supplied by the downstream rollers, until this reaches the downstream pair of rollers. The downstream pair of rollers is then again activated in order to pass the two paper sheets together and deliver them to a holder for subsequent stapling together with a plurality of following paper sheets.

In the case of U.S. Pat. No. 5,289,251, the drive of the two rollers of the downstream pair is completely stopped. In the case of the European patent application 0 613 846, one of the rollers of the downstream pair has a surface with a higher coefficient of friction than the other roller of that pair. The required retention effect is then obtained for the first paper sheet simply by stopping the roller with the higher coefficient of friction. During buffering, the first paper sheet can escape from the path ordinarily taken by the paper sheets. This can also be done constrainedly, by disposing the two pairs of rollers a distance apart less than the length of the paper sheet, so that as the upstream pair of rollers continues to be driven, the trailing part of the first paper sheet will be considerably bent out of the feed path.

Another solution is known from Research Disclosure 1978/16731 and U.S. Pat. No. 4,511,297. Here, before they are delivered to a collecting station, the paper sheets are taken around a relatively large roller, on the outside of which guide paths are provided for the paper sheets. They then arrive at a pair of drive rollers, which can be stopped in order to retain a first paper sheet in order to form a buffer. The first paper sheet will tend to lie against the guide and leave space free at the radial inside for the undisturbed reception of a second following paper sheet. When the second paper sheet has arrived at the pair of rollers, this pair is again operated in order to deliver both sheets to the collecting station.

A disadvantage of these known devices is that to deflect the trailing part of the paper sheet for buffering out of the feed path, they are highly dependent on characteristics of the paper sheet, such as stiffness and flatness and are therefore less suitable for retaining more than one paper sheet, and this limits the time available for carrying out group processing on a bundle of paper sheets preceding the paper sheets for buffering. In particular, a thin and/or curled paper sheet can, during retention, easily jam with its trailing edge in the feed path, and this can lead to transit problems.

Another solution is known from U.S. Pat. No. 5,303,017. The apparatus described therein comprises a driven pair of rollers upstream and a downstream pair of rollers drivable in two directions, with a straight guide path between them. A deflector flap is provided in the guide path and is movable between a position in which the transit path between the two pairs of rollers is free, and a position in which, as considered in the opposite direction to the processing direction, a branch path is created which deflects downwardly. The branch path is defined by guide plates extending curvedly in the downward and upstream direction, while in addition, a third pair of rollers drivable in two directions is disposed in the branch path. When a first paper sheet has been transported through the downstream pair of rollers to an extent such that the trailing edge has passed the deflector flap, this pair of rollers is stopped and the deflector flap is operated into an obliquely downward position. The downstream pair of rollers is then driven in the opposite direction and engagement of the deflector flap on the (initial) trailing edge of the first paper sheet ensures that this paper sheet will follow the deflecting branch path and is engaged by the trailing edge by the third pair of rollers driven in the same direction, with which the first paper sheet must be moved further after the (initial) leading edge has disengaged from the downstream pair of rollers. When the (initial) leading edge of the first paper sheet has passed the deflector flap, the flap is operated to release the main transit path and it is fed to the downstream pair of rollers by means of the upstream pair. The rollers of the third pair are then also driven in the opposite direction in order to force the first paper sheet into the main transit path and to the downstream pair of rollers. Thus, both paper sheets are driven with separate means, arriving jointly, with the second paper sheet somewhat forward, and are engaged by the downstream pair of rollers, in order to be together passed on and delivered to the collecting station situated downstream thereof.

A disadvantage of the apparatus known from U.S. Pat. No. 5,303,017 is that it is fairly complex, necessitates shunting movements over relatively long distances, and thus occupies relatively considerable space, while in addition it is only suitable for retaining just one paper sheet, since only one paper sheet can be fed at a time to the branch path.

SUMMARY OF THE INVENTION

It is an object of the invention to provide an improvement here and, in particular, a method suitable for retaining more than one paper sheet during the buffering operation, for use in printing apparatus delivering paper sheets in rapid succession.

In the method according to the invention, the downstream second transport means always play a part in the engagement of the paper sheets. Consequently, the shunting difference in forming the buffer is never larger than the length of a paper sheet and, with constant speed, the shunting time required for the buffering operation can be kept to a limited value. The continuing engagement by the second transport means guarantees reliable transit of the group of paper sheets that has been formed.

Preferably, successively for each assembled group:

a) a paper sheet is fed by the first transport means to the second transport means and engaged by the latter for further transport, whereby the paper sheet during passage over the guide means is fed along a passage provided therein and provided with paper sheet deflecting means, b) the second transport means are stopped after the trailing edge of the paper sheet has passed the deflecting means, c) the second transport means are driven in the opposite direction until the trailing edge is forced out of the main transit path by the deflecting means, d) while the paper sheet is retained by the second transport means a following paper sheet is fed through in the processing direction by the first transport means, e) the second transport means are driven in the processing direction when the leading edge of the following paper sheet has come near the second transport means, and f) the drive of the second transport means is continued until 1) if the group is completed, the group is passed on by the second transport means and delivered to the next station, or 2) if the group is not completed, when the trailing edge of the following paper sheet has passed the deflecting means, the steps (c) to (e) inclusive are repeated.

Preferably, step (b) is performed directly after the trailing edge of the paper sheet has passed the deflecting means. This gives a saving of space in the processing direction.

Preferably, the paper sheets are passed over paper deflecting means in the form of a deflecting member extending into the main transit path. Preferably, the deflecting member is in the form of a passive deflector flap lightly stressed towards the main transit path. The deflector flap can then easily be pressed aside by a paper sheet of a group for formation, in order then automatically to occupy the position required for the shunting or return movement of the first paper sheet.

Preferably, the paper sheets are returned over the paper deflection means. The weight of the paper sheet then contributes to the deflection. In the case of a (passive) deflector flap, the weight thereof will counteract its pressing aside by a paper sheet of a group when the same is moving in the main transit path.

If the guide means have a curved path, the deflection means can define a downstream directed passage in the outside bend of the main transit path and when the first paper sheet for buffering is situated in the outside bend and following paper sheets for buffering are on the side of the first paper sheets facing the inside bend, the trailing part of the first paper sheet can during buffering escape outwardly to reach the branch path in which the first paper sheet is returned. In that case, there is no need for a moving part such as a deflector flap.

Preferably, the group of paper sheets is so assembled that the leading edges of the paper sheets are offset relatively to one another in the processing direction with the leading edge of the first paper sheet situated underneath at the front. As a result, following paper sheets in a group can readily skim over previous paper sheets in the same group; in the case of deflecting means which are operative in a downward direction, this also ensures a flowing unobstructed deflection of the trailing zone of the group of paper sheets, which zone is also formed after the style of roof tiling.

In one embodiment of the invention, the transport speed of the first transport means is controlled to delay the paper sheet on passage to the second transport means. Thus, a paper sheet fed at high speed can be retarded before reaching the second transport means.

An apparatus of this kind is simple and will operate reliably.

The apparatus according to the invention is preferably provided with control means for controlling the speed of the first and/or the second transport means. To perform the method according to the invention, the second transport means should be stopped after retardation, accelerated, and then be driven at a speed corresponding to that of the first transport means, in order to avoid damage to the paper sheets.

In this case, the apparatus preferably comprises first sensor means for detecting paper sheets to be passed through the first transport means. The speed of the second transport means can then be controlled for feeding, stopping, returning and again passing the sheets after a time that the paper sheet has been engaged by the second transport means.

In the formation of a group of paper sheets, the arrival of the leading edge of a following paper sheet at the first transport means can be detected in order to define the time that the second transport means start and to define the time of reversal of the drive direction of the second transport means.

Preferably, the apparatus also comprises second sensor means for detecting the arrival of the trailing edge of a paper sheet and/or the leading edge of a following paper sheet in the zone upstream of the second transport means, the control means being adapted to control the speed of the second transport means, at least in response to a signal from the second sensor means. Thus, when the trailing edge of a paper sheet is detected, the drive of the second transport means can be braked in order to retard the paper sheet before the paper sheet is released by the second transport means. The second sensor means are also usable to determine that paper sheets have passed through the main transit path and are in the station for further treatment.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
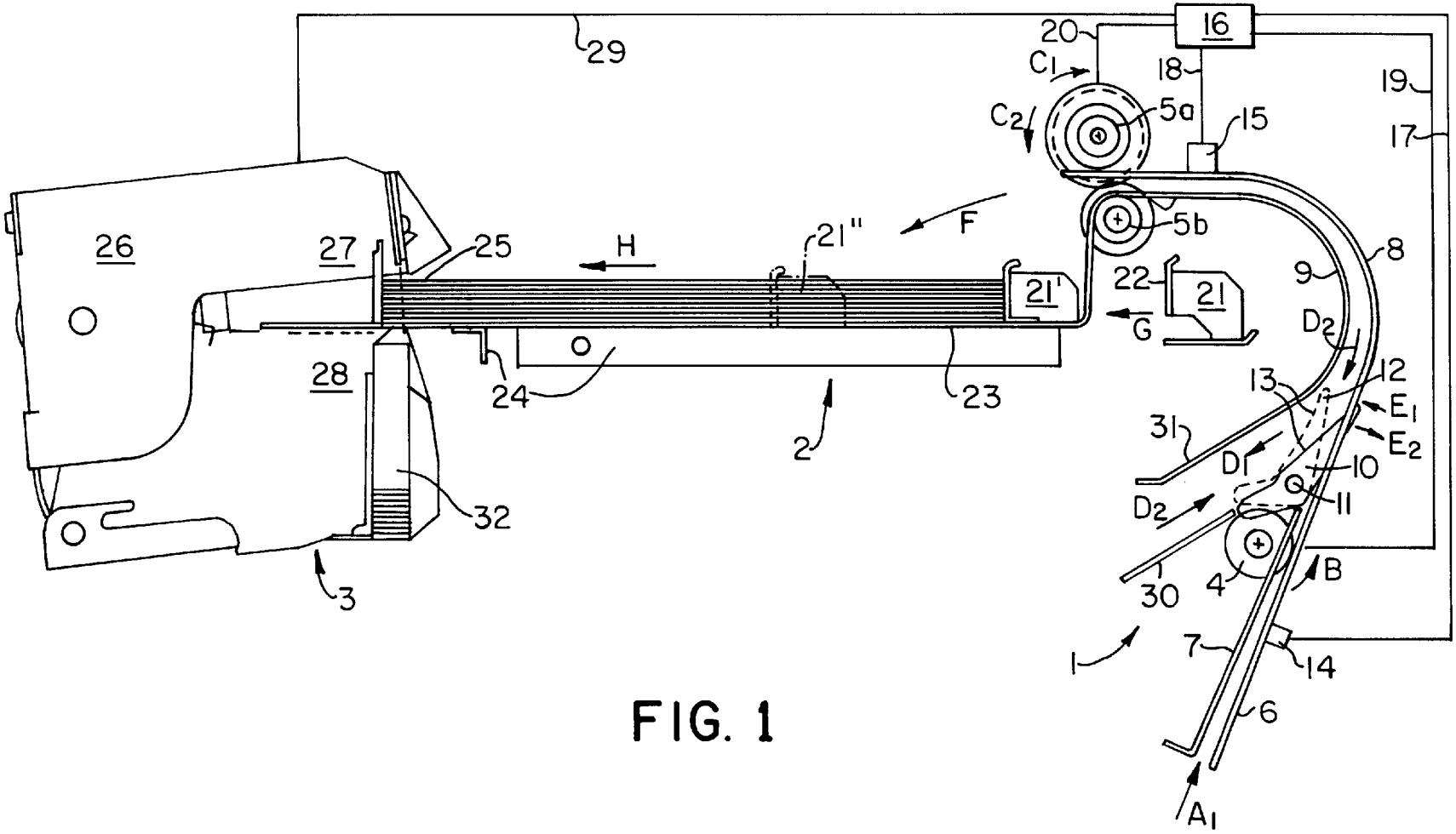
FIG. 1 is a diagrammatic layout of an end station in a printing apparatus, provided with a buffer device according to the invention.

The part of a printing apparatus shown in FIG. 1 comprises a feed and buffer device 1, a collecting device 2 and a stapling device 3.

The buffer device 1 comprises first transport means formed by rollers 4 drivable in the direction B to drive sheets of paper successively in the direction A1. The main feed path for paper sheets is defined by guides 6 and 7, guide 6 merging into curved guide 8 and guide 7 ending at a passive deflector flap 10 tiltable about pin 11. One side of the deflector flap 10 is provided with a guide surface 12, and the back of the deflector flap 10 is provided with a guide surface 13. The flap 10 will drop in the direction E2 by its own (low) weight, possibly assisted by spring pressure, but can be forced in the direction E1 by the forces exerted by a sheet of paper moving upwardly in the direction A1, to pass the sheet in question to the transit path defined by the curved guide 8 and an adjacent curved guide 9. Together with guide 30, the guide surface 13 can form a branch path to receive and deliver a sheet of paper in the directions $D_1$ and $D_2$ respectively. The other side of the branch path is defined by a guide 31 which is connected to the guide 9. No drive means are provided between guides 30 and 31.

The curved guides 8 and 9 lead directly to second transport means formed by driven rollers 5*a* and 5*b*. These rollers 5*a* and 5*b* are selectively drivable in the directions C1 and C2. Upstream of the roller system 4, a paper sheet detector 14 is disposed. Downstream of the roller system 4, a paper sheet detector 15 is disposed. These detectors are adapted to detect transverse edges of paper sheets. They deliver associated signals to a central control unit 16 via leads 17 and 18. As will be indicated hereinafter, control is also based on the drives of the rollers 4, 5*a* and 5*b*, for which purpose the control unit 16 is connected by leads 19 and 20 to the drives of the rollers 4, 5*a* and 5*b*. Lead 19 can be dispensed with if rollers 4 are driven continuously.

Downstream of the rollers 5*a*, 5*b* is the collecting device 2 with a paper sheet receiving tray 23 which receives paper sheets falling in the direction F and is supported by profiles 24 secured (in a manner not shown) in the printing device. The paper sheet receiving tray 23 has at the downstream end an abutment 25, and at the upstream end there is a pusher or jogger 21 provided with an abutment surface 22. The pusher 21 is mounted a in manner not shown in detail, and is slidable in the direction G to position 21', in which the paper sheets which have dropped down into the tray 23 are pushed against the abutment 25 and subsequently, after the collected paper sheets have been stapled together, in direction H to position 21", in order to eject the stapled bundle of paper sheets from the printing apparatus of course, ejection can be replaced by a moving clamp or a roller transport.

Located on the left of the paper sheet receiving tray 23 in FIG. 1 is the stapling machine 3, which is controlled by the control unit 16 via line 29. The stapling unit comprises a stapling head 28 fixed at least in the vertical plane, and a clincher 27 movable about hinge 26. The stapling head 28 is provided with a staple supply 32 and will be capable of operation to some extent upstream of the abutment edge 25. After a bundle of papers has been stapled together, the stapling device 3 can be swung away in a direction perpendicular to the plane of the drawing, whereafter the jogger 21 can perform its ejection function.

FIGS. 2A–2F show the way in which the buffer device 1 according to the invention operates. The device 101 shown in FIGS. 2A–2F differs to some extent from that shown in FIG. 1, but the operating principle is the same.

The device 101 illustrated is situated upstream of a collecting and stapling device, also termed a finisher. On the upstream side are rollers 104*a* and 104*b* drivable in the directions B. On the downstream side are rollers 105*a* and 105*b* drivable in the directions C1 or, as required, in the opposite directions C2 (see for example FIG. 2C). The two pairs of rollers referred to are shown located at an exaggerated distance apart. It will become clear that the pairs of rollers each form a nip.

Proceeding downstream from the pair of rollers 104*a*, 104*b* there are first guides 106 and 107 and then an opening extending at least in the downward direction and into which one end of the deflector flap 110 extends, the flap being pivotable about pin 111. Downstream thereof are guides 108 and 109 extending as far as the set of rollers 105*a*, 105*b*.

Figure 2A:
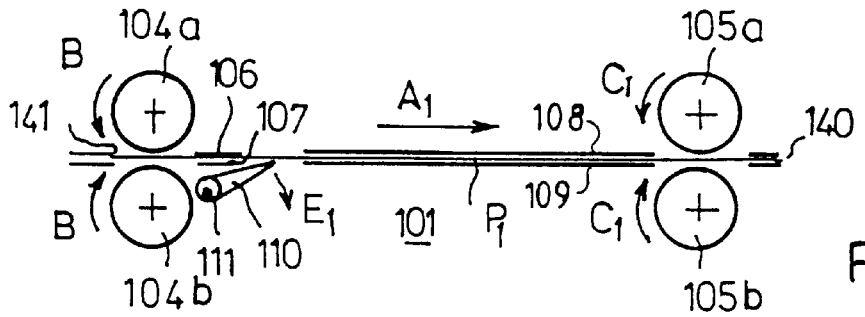
FIGS. 2A–2F diagrammatically show different stages in the performance of the buffer method according to the invention.

FIG. 2A shows a paper sheet P1, the leading edge 140 of which is already downstream of the set of rollers 105*a*, 105*b*, and is driven by the two sets of rollers in the direction A1. The rear or trailing edge 141 of the paper sheet P1 is still just upstream of the set of rollers 104*a*, 104*b*. When the stapling device is started by the control unit 16, via lead 29, to staple a group of collected paper sheets, the control unit will start the buffer device after the sensor 14 (FIG. 1) has detected the leading edge of a first paper sheet following the collected paper sheets.

The paper sheet P1 presses the deflector flap 110 downwards in the direction E1, so that transport can take place in direction A1 without difficulty.

Figure 2B:
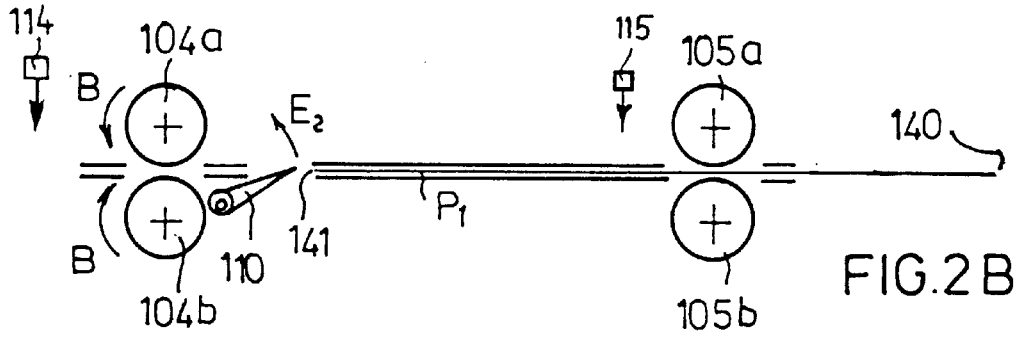
Figure 2C:
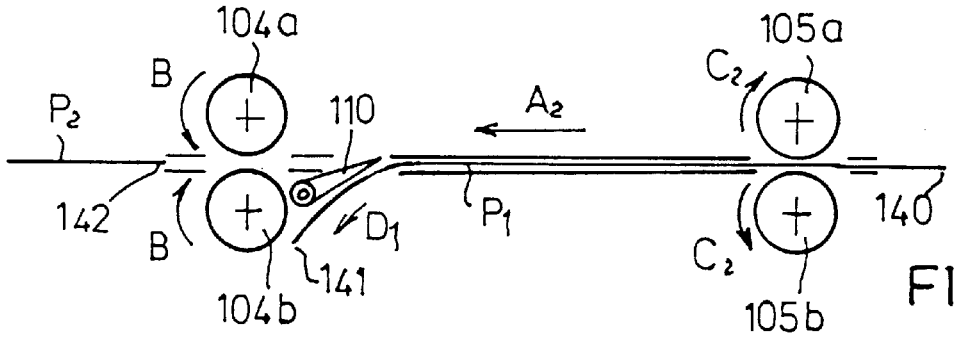
Figure 2D:
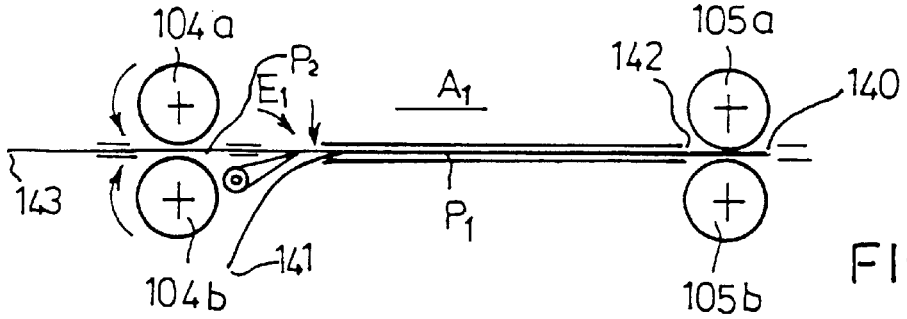
Figure 2E:
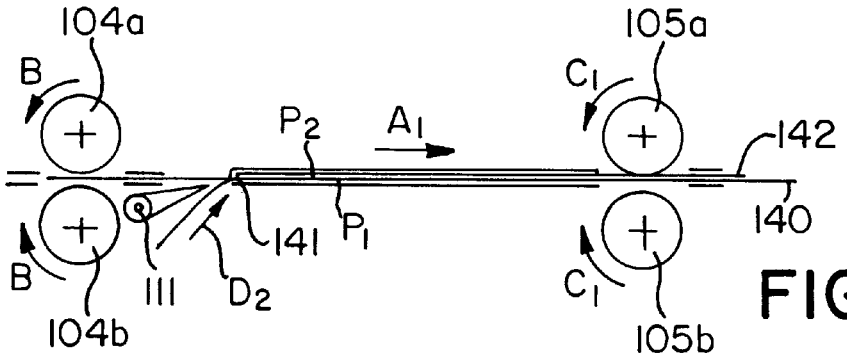

FIG. 2B shows the situation in which the trailing edge 141 of the paper sheet P1 has passed the deflector flap 110, as confirmed after expiration of a fixed time after a sensor 114 has detected the leading edge of the next paper sheet after the last sheet of a previous group of sheets which has undergone a subsequent group operation, e.g. stapling, and will swing this deflector flap upwards to some extent in the direction E2, e.g. under the influence of a spring, into the path taken by the paper sheet P1. The roller set 104*a*, 104*b* can continue rotating. The roller set 105*a*, 105*b*, however, is stopped by the control unit responding to the signal of sensor 115 and then its direction of rotation is reversed, to give the situation shown in FIG. 2C, when the rollers 105*a*, 105*b* rotate in the directions C2 and paper sheet P1 returns in the direction A2 and is deflected by its rear zone, more particularly the trailing edge 141, in the direction D1 by the deflector flap 110. In the meantime, a following sheet of paper P2 arrives with its leading edge 142 in the nip 104*a*, 104*b* and is thus engaged, as shown in FIG. 2D, for transport in the direction A1 to the nip 105*a*, 105*b*, the deflector flap 110 again being pivoted downwards to some extent in the direction El. In these conditions, the paper sheet P2 moves in the direction A1 over the paper sheet P1, which is then still stationary. Only when, for example, detection means 14 shown in FIG. 1, confirm that the leading edge 142 of paper sheet P2 has arrived near nip 105*a*, 105*b* (a fixed time after the detection, given a constant speed of passage), the rollers 105*a*, 105*b* are accelerated by the control unit in direction C1, so that at the time of engagement of the leading edge 142 of the paper sheet P2 by the roller 105*a*, the peripheral speed of the roller 105*a* is equal to that of roller 104*a*. The paper sheets P1 and P2 are engaged together by the rollers 105*a* and 105*b*—although with some offsetting, the leading edge 140 being somewhat in advance of the leading edge 142—and transported on in direction A1 by rotation of the two rollers in the directions C1, as shown in FIG. 2E. The trailing edge 141 of paper sheet P1 then slides along the deflector flap 110 to come between the guides 108, 109.

Figure 2F:
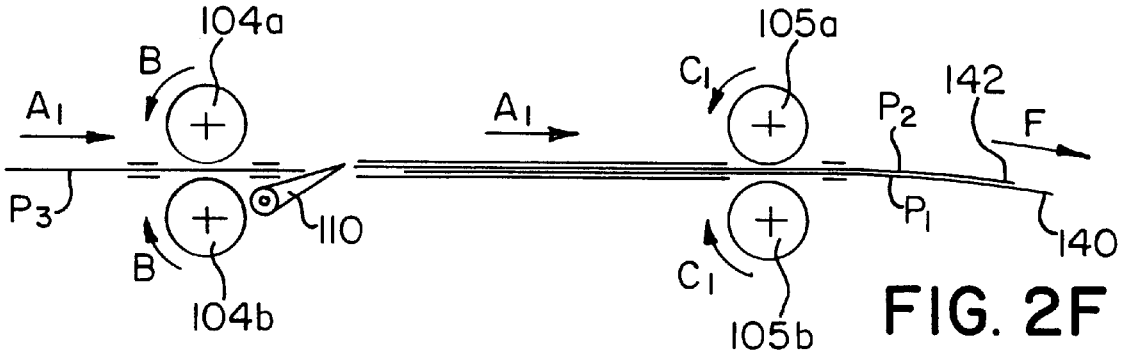

If, as shown in FIG. 2F, the group consisting of paper sheets P1 and P2 is delivered by the rollers 105*a*, 105*b* in direction A1 and downwards in the direction F to the collecting device (reference 2 in FIG. 1), a following paper sheet P3 already arrives at the nip 104*a*, 104*b* and if the bundle for buffering does not have to consist of more than two paper sheets, the paper sheet P3 is passed on by the rollers 104*a*, 104*b* and by the rollers 105*a*, 105*b* in the direction A1 and direction F to the collecting device in order to come together with sheets P1 and P2 there. Otherwise, the paper sheet P3 will be treated in the same way as sheet P2. Thus, a number of paper sheets can be buffered to offer sufficient time for stapling a preceding group of paper sheets.

The controllability of the speed of the rollers 105*a*, 105*b* can be further utilized to control the speed of discharge in the direction F, e.g. in response to the passage of a trailing edge of the paper sheet P3 which has to be stapled together with buffered paper sheets P1 and P2 and in response to the passage of trailing edges of paper sheets P4–Pn which may have to be stapled together with paper sheets P1–P3. By reducing the speed of the rollers 105*a* and 105*b* in such cases, sheets are prevented from reaching the abutment 25 at too high a speed, which might result in damage.

Figure 3:
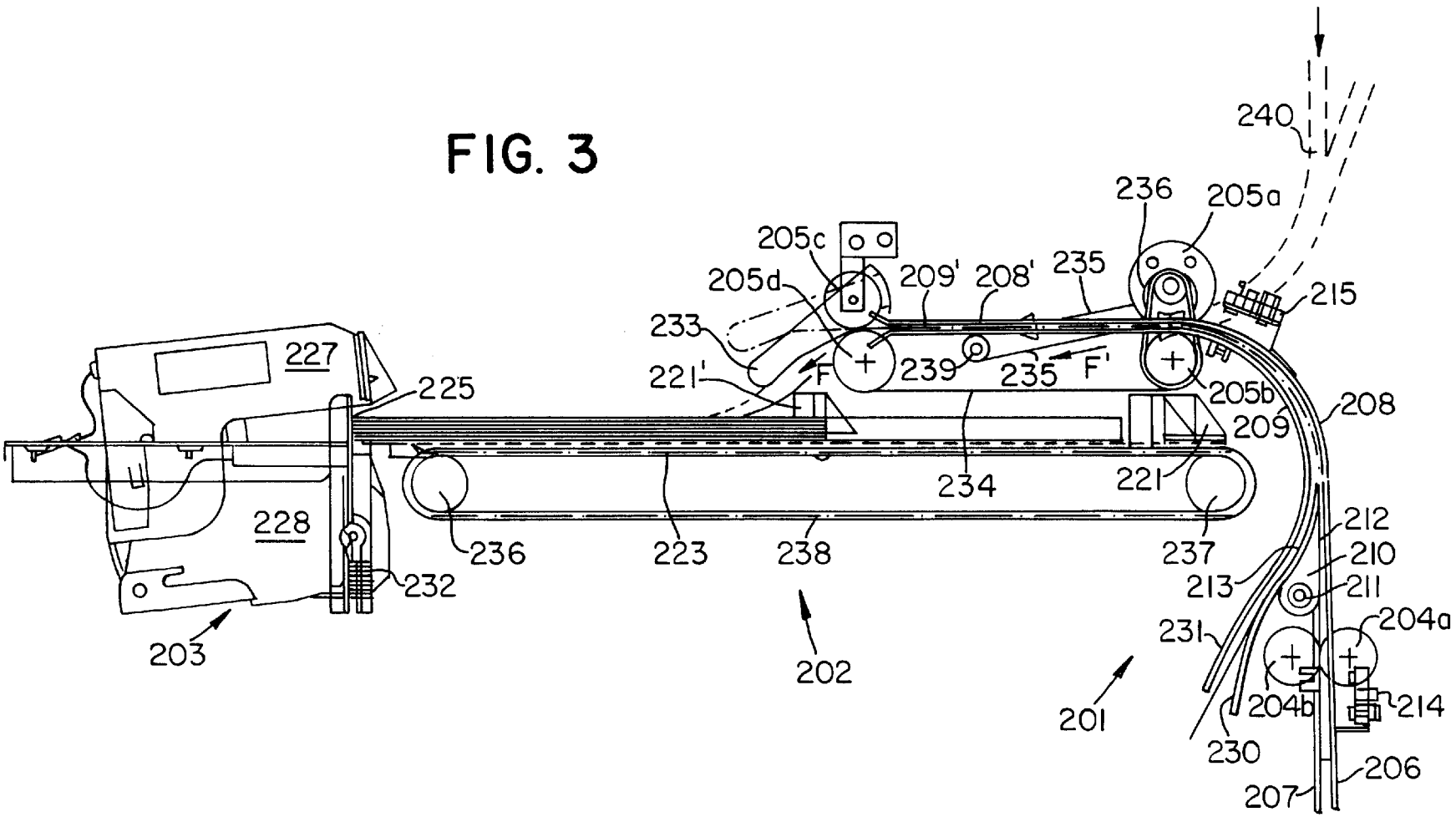
FIG. 3 is a diagrammatic layout of an end station in a printing apparatus provided with an alternative buffer device according to the invention.

FIG. 3 shows an alternative arrangement of a finisher-buffer apparatus according to the invention. Like parts have essentially the same references as in FIG. 1, except that two hundred has been added to each of the reference numerals. The most important differences will now be discussed.

In the feeder and buffer device 201 the curved guides 208, 209 are lengthened in the downstream direction by guides 208', 209', while an extra pair of driven rollers 205*c*, 205*d* is also provided downstream of the driven pair of rollers 205*a*, 205*b*, at the end of the guides 208', 209'. The roller 205*b* is drivingly coupled to a motor by means of a driving belt 236. The drive of the rollers 205*a*, 205*b* is controlled, the rollers 205*a* and 205*b* being drivable in two opposite directions. Since the rollers 205*b* and 205*d* are coupled by a driving belt 234, the same applies to the rollers 205*c* and 205*d*.

At the rollers 205*c*, 205*d*, a freely pivotable finger 233 is mounted to ensure that the sheets delivered in the direction F are forced with their leading edge downwards to bring the sheets to a position in which they lie flat in front of the jogger 221 in order to ensure that on the subsequent ejection action of the jogger 221, all the papers sheets are entrained and do not push the jogger 221 under curled top sheets. Paper sheets can also be prevented from jamming by their curled trailing edge by means of gripper fingers (not shown) pivotally secured to the jogger 221, which fingers, on each jogger movement after a paper sheet has been placed in the collecting station, are moved down by a cam to press the trailing edge of the deposited paper sheet downwards.

The collecting device 202 is extended in the upstream direction. This extension coincides with the extension 208', 209'of the guides 208, 209. As a result of the extension of the collecting device 202, the latter is also suitable for receiving sheets having a greater length dimension, more particularly the "legal size", with a length of 356 mm, whereas the most usual sheets have a length of 210 mm (A4).

When legal size sheets are processed, the jogger 221 will have moved completely to the right. This jogger 221 can be moved by means of a belt 238 connected thereto and running over rollers 236 and 237, one of which is driven. In order to prevent the legal size sheets from coming between the extended guides 208', 209', a deflector flap 235 is disposed directly downstream of the rollers 205*a*, 205*b*. The deflector flap 235 is pivotable about hinge 239 and adjustable by means (not shown) between a position in which the passage between guides 208', 209'is free, and a position in which the upstream end of the flap extends completely into the passage, directly downstream of the rollers 205*a*, 205*b*. The flap 235 comprises a number of fingers which can extend through correspondingly shaped slots in guides 208'and, in their bottom position, form a part of the guide 209'. The legal size sheets can be forced by the flap 235 directly obliquely downwards in the direction F'in order to arrive in the paper sheet receiving tray 223.

When shorter sheets are to be processed, e.g. A4 sheets, the jogger 221 as considered in the drawing is moved to the left to the position 221'. During buffering, the buffered sheets will be supported over the major part of their length by the guide 209'and cannot therefore jam in the collecting device 202 in an obstructive manner which would interfere with the process. Thus, the apparatus shown in FIG. 3, in which the extra space occupied is only limited, gives two advantages, namely in one case the possibility of processing sheets of a greater length and secondly more reliable operation of the collecting device.

After the collected sheets have been stapled together, the jogger 221 can be moved further to the left by the drive of the belt 238 in order to eject the stapled bundle to the left from the collecting device 202.

The devices shown in FIGS. 1 and 3 are adapted for use in a printing apparatus in which a group of copy sheets which together form a copy set enter the buffer device with page 1 at the front and on the side facing guide 7 or guide 207 respectively. Since the paper sheet remains with page 1 in the inside bend between guides 9 and 8, 209 and 208 respectively, a deflector member 10, 210 respectively is necessary to push the trailing edges of the paper sheets for buffering away in the inside bend. When the main transit path contains a downwardly curved path portion 240 shown in broken lines in FIG. 3, instead of an upwardly curved path portion 8/9, 208/209 respectively, the first paper sheet pushed forward in a set remains in the outside bend to come at the bottom on subsequent collection in the collecting station. As noted previously, in that case, a deflector flap can be dispensed with if the trailing part of the outermost paper sheet remains on the outside of the curved paper path as a result of its stiffness (and comes into the branch path 241 on return) on the supply of subsequent paper sheets to the inside of pushed-away previously supplied paper sheets.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of assembling successively fed paper sheets subjected to a printing treatment into a group, and groupwise delivery thereof to a following station for further treatment, comprising the steps of:

feeding the paper sheets by first transport means along a main transit path over guide means to second transport means situated at a distance therefrom in a processing direction;

engaging the paper sheets by said second transport means for transport in the processing direction;

temporarily driving the second transport means in an opposite direction for the purpose of receiving each following paper sheet in the group:

maintaining the second transport means in positive engagement with the group of paper sheets during formation of the group; and wherein successively for each assembled group:

a) a paper sheet is fed by the first transport means to the second transport means and engaged by the latter for further transport, wherein the paper sheet during passage over the guide means is fed along a passage provided therein and provided with paper sheet deflecting means, b) the second transport means are stopped after a trailing edge of the paper sheet has passed the deflecting means, c) the second transport means are driven in an opposite direction until said trailing edge is forced out of the main transit path by the deflecting means, d) while the paper sheet is retained by the second transport means, a following paper sheet is fed through in the processing direction by the first transport means, e) the second transport means are driven in the processing direction when a leading edge of the following paper sheet has come near the second transport means, f) the drive of the second transport means is continued until:

1) if the group is completed, the group is passed on by the second transport means and delivered to the next station, or 2) if the group is not completed, when the trailing edge of the following paper sheet has passed the deflecting means, the steps (c) to (e) inclusive are repeated.

2. The method according to claim 1, wherein a transport speed of the second transport means is controlled according to a processing speed of the following station.

3. The method according to claim 1, wherein the step b) is performed directly after the trailing edge of the paper sheet has passed the deflecting means.

4. The method according to claim 1, wherein the paper sheets are returned over the paper deflecting means in the form of a deflecting member extending into the main transit path.

5. The method according to claim 4, wherein the paper sheets are returned over the deflecting member in the form of a passive deflecting flap lightly tensioned in the direction of the main transit path.

6. The method according to claim 4, wherein the paper sheets are returned over the deflecting member.

7. The method according to claim 1, wherein the guide means have a curved path, and wherein the deflecting means define a downstream directed passage in an outside bend thereof.

8. The method according to claim 1, wherein the group of paper sheets is so assembled that leading edges of the paper sheets are offset relatively to one another in the processing direction with the leading edge of the first paper sheet situated underneath at a front.

9. The method according claim 1, wherein a transport speed of the first transport means is controlled to retard the paper sheet on passage to the second transport means.

10. An apparatus for assembling successively fed individual paper sheets which are subjected to a printing treatment and groupwise delivery thereof to a station for further treatment, comprising:

first transport means adapted to be driven at least in a processing direction for successively feeding and passing the individual paper sheets;

second transport means disposed downstream of the first transport means and drivable in the processing direction and in an opposite direction;

first guide means disposed between the first transport means and the second transport means for guiding the paper sheets in the processing direction along a main transit path;

second guide means disposed between the first and second transport means for guiding at least one paper sheet in a direction opposed to the processing direction and out of said main transit path into a branch path when the second transport means are driven in the opposite direction, wherein the second guide means form a free transit path for the paper sheets and are situated at a distance upstream of the second transport means which is less than a length of the paper sheets; and third transport means disposed downstream of the second transport means, said third transport means adapted to be drivably coupled to the second transport means, and wherein third guide means are disposed between the second transport means and the third transport means and are movable between a first position in which they guide sheets from the second transport means to the third transport means, and a second position in which they deflect sheets directly after the second transport means to a further processing station.

11. The apparatus according to claim 10, further comprising control means for controlling the speed of at least one of the first transport means and the second transport means.

12. The apparatus according to claim 11, further comprising first sensor means for detecting the passage of a paper sheet through the first transport means.

13. The apparatus according to claim 12, further comprising second sensor means for detecting the arrival of a trailing edge of at least one of a paper sheet and a leading edge of a following paper sheet in a zone upstream of the second transport means, wherein the control means are adapted to control the speed of the second transport means, at least in response to a signal from the second sensor means.

14. The apparatus according to claim 10, wherein the second guide means comprise a deflector which inclines to a position which shields a portion of the main transit path extending in the upstream direction of said deflector but is operable to release the portion of the main transit path in the processing direction between the first transport means and the second transport means.

15. The apparatus according to claim 14, wherein the deflector is prestressed.

* * * * *